US010712137B1

(12) United States Patent
McGowan et al.

(10) Patent No.: US 10,712,137 B1
(45) Date of Patent: Jul. 14, 2020

(54) METHOD FOR MAKING A COMPOSITE FRAGMENTATION CAP THAT IS INTEGRALLY FORMED ONTO A PROJECTILE BODY

(71) Applicant: U.S. Government as Represented by the Secretary of the Army, Picatinny Arsenal, Dover, NJ (US)

(72) Inventors: Joshua McGowan, Churchville, PA (US); Michael E. Ellis, Lake Hopatcong, NJ (US); Tony Zahrah, Fairfax Station, VA (US); Deepak Kapoor, Rockaway, NJ (US); Steven Lawver, Sterling, VA (US); Sergio Torrejon, Leesburg, VA (US); Roderick Rowland, Fairfax, VA (US); John Brough, Fredericksburg, VA (US); James Grzybek, Hopatcong, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 16/395,632

(22) Filed: Apr. 26, 2019

(51) Int. Cl.
*F42B 12/32* (2006.01)
*B22F 3/15* (2006.01)

(52) U.S. Cl.
CPC ..... *F42B 12/32* (2013.01); *B22F 3/15* (2013.01)

(58) Field of Classification Search
CPC ..... F42B 12/22; F42B 12/32
USPC ..... 102/494, 496, 497; 86/51, 53, 56
See application file for complete search history.

(56) References Cited

U.S. PATENT DOCUMENTS

H000343 H * 10/1987 Keown ..... F42B 12/22 102/517
2014/0020590 A1* 1/2014 Torsten ..... F42B 33/00 102/495
2015/0316359 A1* 11/2015 Hales ..... E21B 43/117 175/4.57
2017/0073281 A1* 3/2017 Ackerman ..... F42B 12/22

* cited by examiner

*Primary Examiner* — Bret Hayes
(74) *Attorney, Agent, or Firm* — John P. DiScala

(57) ABSTRACT

Process for making a fragmentation warhead using hot isostatic pressing where tungsten spheres, powdered steel, and interlock features on a mandrel are consolidated in a matrix. Then in the finished part, the front fragmentation cap, rear and interior geometries are machined, resulting in a finished warhead with an enhanced performance fragmentation cap integrally bonded to it.

4 Claims, 5 Drawing Sheets

METHOD FOR MAKING A COMPOSITE FRAGMENTATION CAP THAT IS INTEGRALLY FORMED ONTO A PROJECTILE BODY

U.S. GOVERNMENT INTEREST

The inventions described herein may be made, used, or licensed by or for the U.S. Government for U.S. Government purposes.

BACKGROUND OF INVENTION

This invention meets the need for anti-personnel rounds to deliver greater lethal effect and more robust structural integrity compared to traditional rounds within a given caliber size. This goal has been a potential area of improvement since high explosive antipersonnel rounds were first adopted, but it was brought to the forefront when there was a requirement for ammunition to perforate urban targets and provide increased anti-personnel effectiveness. Some existing approaches to achieving desired performance prior to this invention had been: naturally fragmenting steel, enhanced fragmentation steel, and matrixed fragmentation caps. However, naturally fragmenting steel and enhanced fragmentation steel approaches did not provide a large enough area of effect to satisfy the desired requirements. Matrixed fragmentation caps were previously unable to be attached in such a way as to survive impact with the required wall targets, and also limited in the volume that they could be allowed to take up in the warheads overall space. This was due to the fact that they could not include sufficiently adequate or numerous structural members.

BRIEF SUMMARY OF INVENTION

This invention allows preformed fragments, tailored in size, shape, and material, to be embedded in a close packing density within a matrix of a chosen material that is integrally bonded onto the exterior profile of a warhead. These preformed fragments offer increased lethality when compared to a steel warhead. The inherent steel underbody and integral bonding method offers improved structural integrity and increased flexibility in preform placement when compared to prior matrixed fragmentation cap methods.

The components for fabricating the composite fragmentation cap integrally bonded to the projectile underbody include a hot isostatic pressing (HIP) canister 1, a steel underbody 2, selected fragmentation preforms 4, powdered binder material 5, welded canister sealing caps 6, and a welded vacuum stem 7.

Ammunition design practices must be used to achieve desired performance by determining required underbody geometry and material, binder material, cap geometry, preform size, shape, packing density, and material selection. The ammunition design engineer must balance resulting mass properties, structural integrity, ballistic performance, terminal lethality, cost, and manufacturing limitations to arrive at a final design. Likewise, casing material selection, caliber, shape, interior explosive volume, subcomponent interface, next level assembly constraints and conditions, costs and manufacturing limitations are designed and engineered to satisfy operational needs.

Inherent in the composite warhead design are considerations of structural integrity, lethality, and ballistic performance. The steel underbody is the primary driver of structural integrity, though the fragmentation cap does offer some structural support. Similarly, the fragmentation cap (including the decisions as to preform size, shape, and material) is the primary driver of lethal effect, but the steel underbody does provide some lethal effect. Ballistic performance is driven by inertial properties of the overall composite part, as well as the profile and surface of any fragmentation cap and/or underbody regions that are in the airstream.

The underbody's outer profile is cut onto a cylinder of the desired underbody material; the resulting part is effectively used as a mandrel. The underbody mandrel is then placed in a canister whose inner diameter matches the outer diameter of the underbody mandrel's cylindrical section. The remaining cavity within the canister is then filled with a homogeneous mixture of fragmentation preforms and binder powder. In order to improve chemical bond between underbody and cap, it is desired that a binder material be chosen that is miscible with the underbody material. It is theorized that greater miscibility between fragmentation preform material and binder material will cause greater structural integrity of the fragmentation cap but poorer lethal fragmentation performance.

After the underbody mandrel is placed in the canister and the remaining cavity is filled with cap materials, the canister is closed off and welded shut. A vacuum is then drawn, under a prescribed heating cycle, through the stem in order to remove any gas in the powder that would cause irregularities during the hot isostatic pressing (HIP) process. After degassing is complete, the stem is pinched and welded closed in order to seal the canister.

The contained processing assembly is then placed inside a hot isostatic press. The hot isostatic press is then heated and pressurized to a pre-determined maximum pressure and maximum temperature for the selected binder powder material. At an elevated temperature below the melting point of the canister and underbody materials, a pressurized inert gas such as argon consolidates the canister and its contents. The high temperature, high pressure operation turns the powdered metal binder into a solid piece near the theoretical maximum density of the material. The chosen fragmentation preforms are thereby embedded within a solid matrix of the binder material. Processing parameters (time, temperature, pressure, etc.) are as prescribed for the binder material and desired resultant product.

After cooling, the top and bottom lids are cut and the canister is machined from the consolidated piece. The integrated compacted billet is then final machined to the desired size and profile of the projectile body design.

OBJECTS OF THE INVENTION

Accordingly, it is an object of the present invention to provide a process for making a fragmentation warhead resulting in a finished warhead with an enhanced performance fragmentation cap integrally bonded to it.

Another object of the present invention is to provide a process for making a fragmentation warhead using hot isostatic pressing where tungsten spheres, powdered steel, and interlock features on a mandrel are consolidated in a matrix.

It is a further object of the present invention to provide a process for producing a fragmentation warhead where tungsten spheres, powdered steel, and interlock features on a mandrel are consolidated in a matrix and where in the finished part, rear and interior geometries are machined, resulting in a finished warhead with an enhanced performance fragmentation cap integrally bonded to it.

These and other objects, features and advantages of the invention will become more apparent in view of the within detailed descriptions of the invention, the claims, and in light of the following drawings and/or tables wherein reference numerals may be reused where appropriate to indicate a correspondence between the referenced items. It should be understood that the sizes and shapes of the different components in the figures may not be in exact proportion and are shown here just for visual clarity and for purposes of explanation. It is also to be understood that the specific embodiments of the present invention that have been described herein are merely illustrative of certain applications of the principles of the present invention. It should further be understood that the geometry, compositions, values, and dimensions of the components described herein can be modified within the scope of the invention and are not generally intended to be exclusive. Numerous other modifications can be made when implementing the invention for a particular environment, without departing from the spirit and scope of the invention. The embodiments described herein are included for the purposes of illustration, and are not intended to be exclusive; rather, they can be modified within the scope of the invention. Other modifications may be made when implementing the invention for a particular application.

LIST OF DRAWINGS

DETAILED DESCRIPTION

Figure 1:
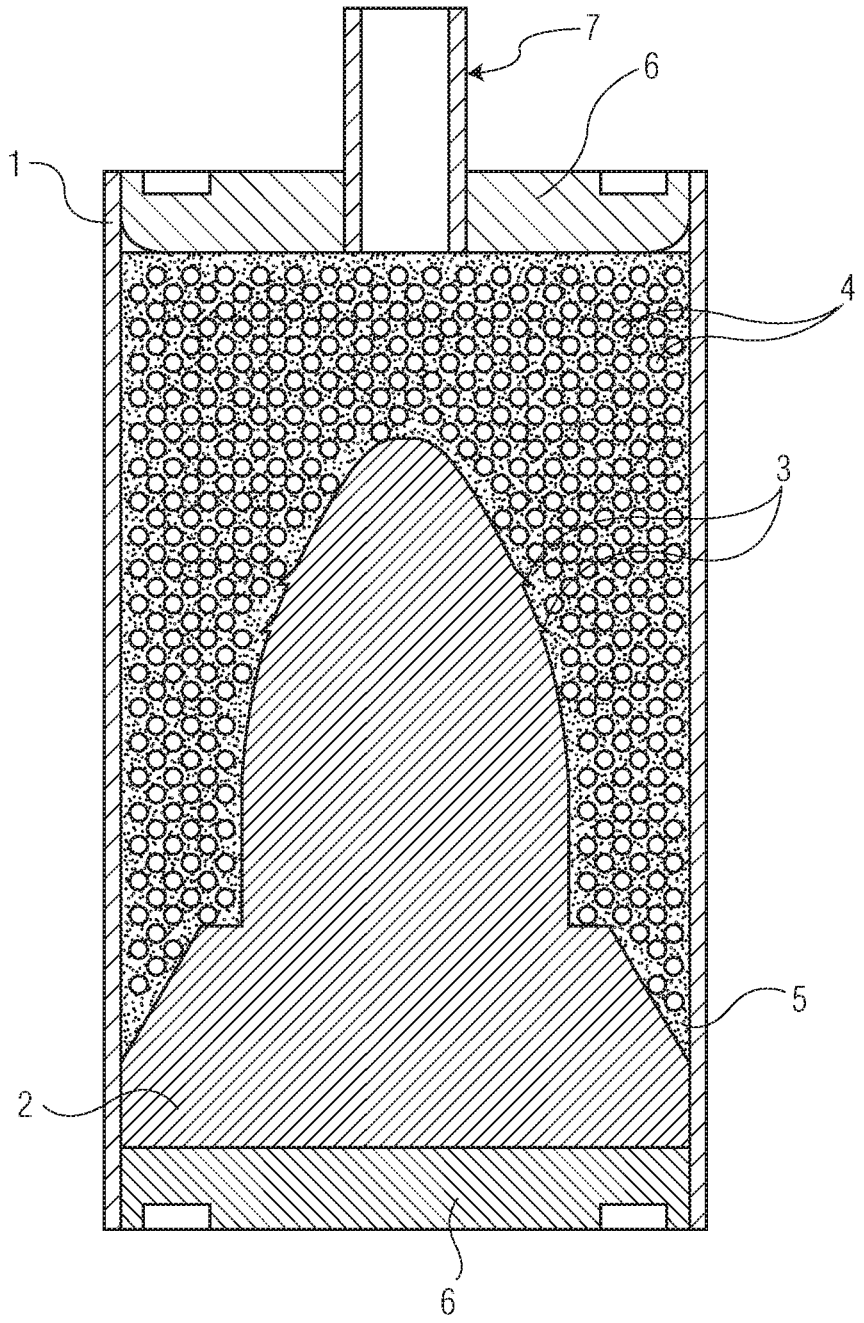
FIG. 1 depicts the cross section of a canister which contains a warhead underbody, tungsten spheres, and powdered steel binder material, for fragmentation cap production in accordance with this invention.

FIG. 1 depicts the cross section of a canister 1 that is packed and ready to be consolidated by a process of hot isostatic pressing (HIP). The canister contains wrought steel 2 that has been machined to have the outer profile of the warhead underbody onto which the composite fragmentation cap is desired to be attached. Depending on how strong the bond is expected to be between underbody and the fragmentation cap, mechanical interlock features 3 may be included on the outer profile of the underbody. The canister also contains the chosen fragmentation preforms, in this case uniform tungsten spheres 4, and the chosen binder material 5, (4340 steel, for example), in powdered form. The canister has been sealed at both ends by welding on sealing caps 6, and a stem 7 has been attached to the top such that a vacuum can then be pulled on the contents of the canister.

Figure 2:
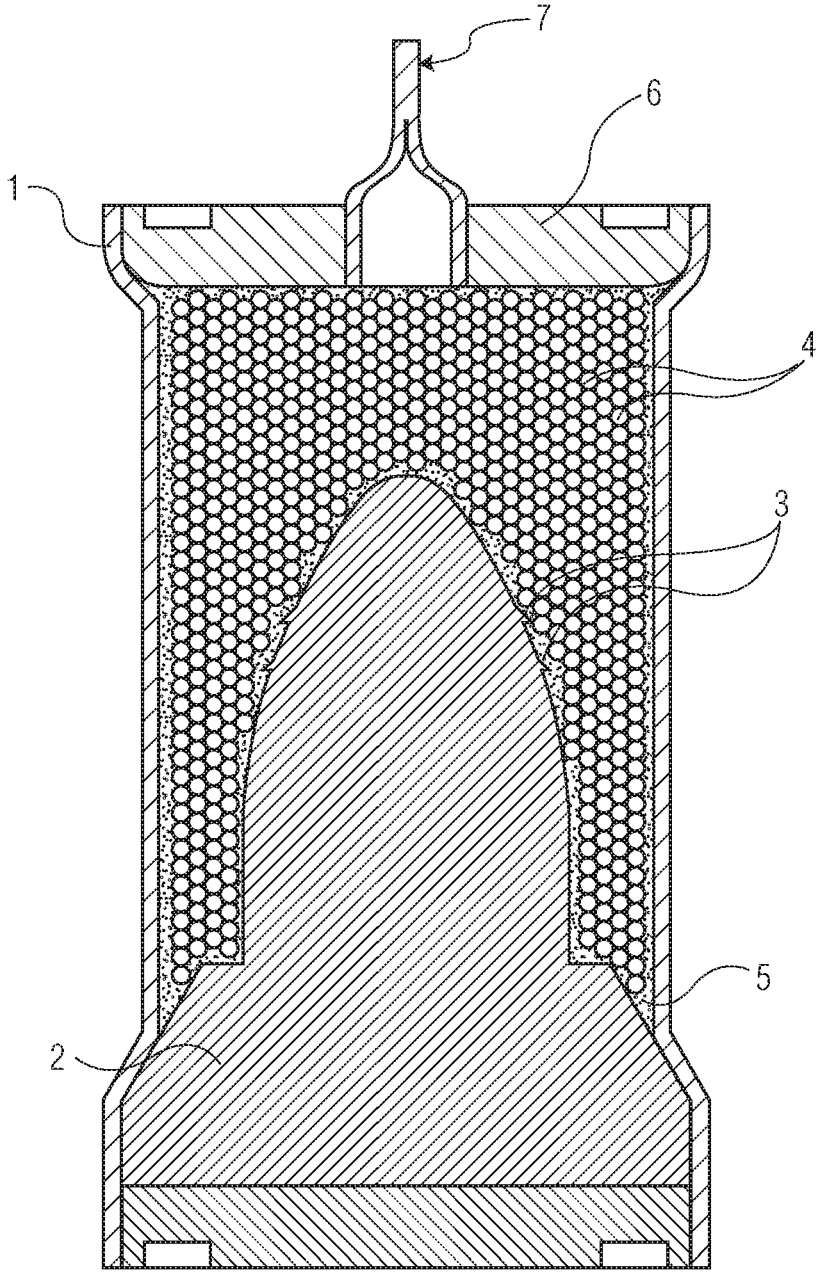
FIG. 2 depicts the cross section of a canister that has been consolidated by a HIP process, solidifying binder and tungsten spheres in accordance with this invention.

FIG. 2 depicts the cross section of a canister 1 that has been consolidated by a HIP process. The binder 5 has been solidified around and chemically bonded to the underbody 2. Mechanical interlock features 3, if used, supplement the adhesion of the chemical bond by creating a physical impediment to dislodgement of the solidified matrix from the underbody. The fragmentation preforms 4 are closely packed and suspended within the matrix of solid binder material. Before HIP, vacuum was pulled through the stem 7, under a prescribed heating cycle, in order to degas the canister. After degassing, the stem 7 was crimped and welded closed (as shown here in FIG. 2) in order to prevent re-entry of gas. The sealing caps 6 are still welded in place, sealing the canister.

Figure 3:
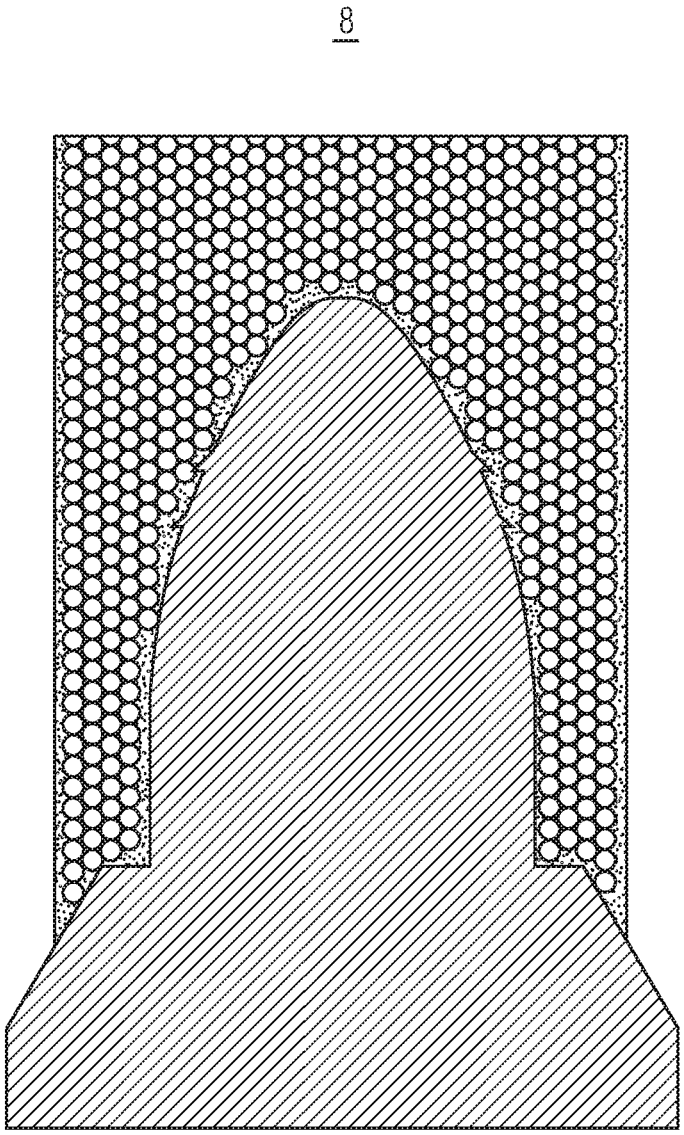
FIG. 3 depicts the cross section of a solidified composite part where the canister and sealing caps are cut off, leaving the composite part ready to be machined to a desired geometry in accordance with this invention.

FIG. 3 depicts the cross section of a solidified composite part 8. The canister 1 and sealing caps 6 are cut off, leaving the composite part ready to be machined to a desired geometry.

Figure 4:
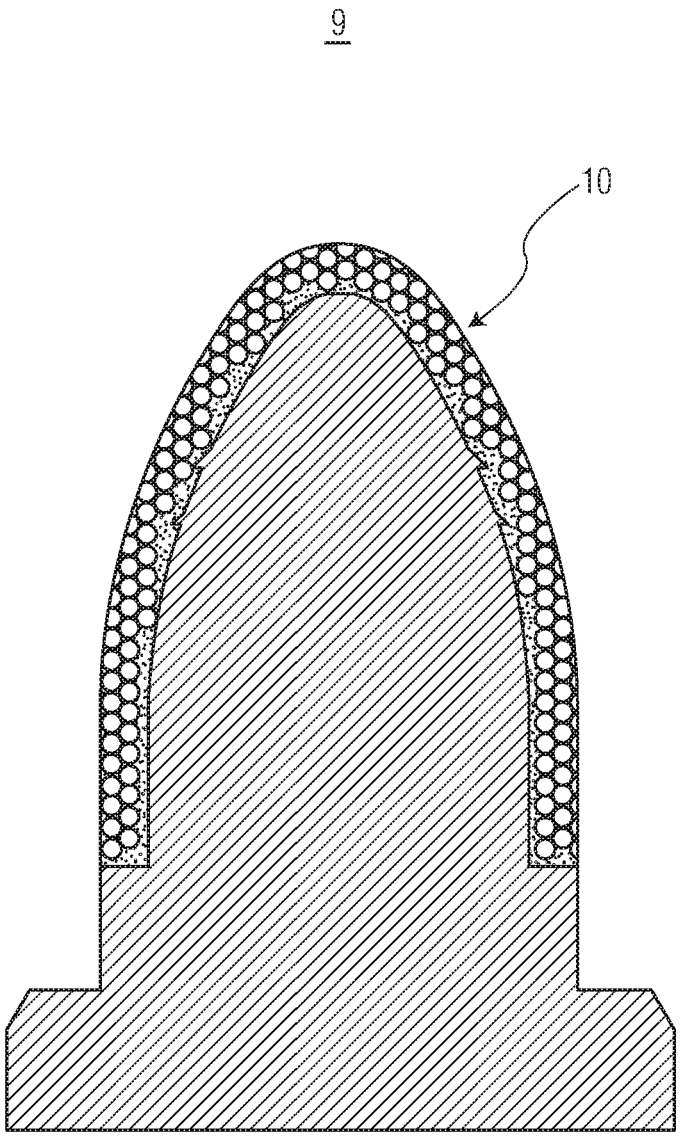
FIG. 4 depicts the cross section of a composite part with the front geometry machined to final shape, in accordance with this invention.

FIG. 4 depicts the cross section 9 of the composite part 8 with the front geometry machined to final shape. During machining, partial fragmentation preforms may be cut and become exposed on the surface of the cap 10. Conversely, the machining operation need not cut the canister 1 completely off the consolidated part. Canister 1 artifacts can remain to become part of the final integrated part if desired.

Figure 5:
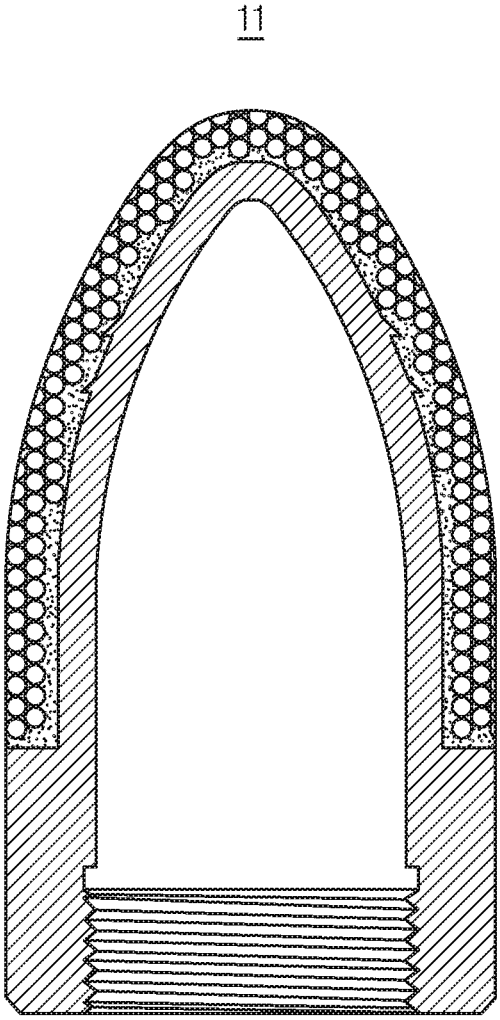
FIG. 5 depicts a finished, machined, fragmentation cap piece, in accordance with this invention.

FIG. 5 depicts the finished part 11. The rear and interior geometries have been machined, resulting in a finished warhead with an enhanced performance cap integrally bonded to it.

While the invention may have been described with reference to certain embodiments, numerous changes, alterations and modifications to the described embodiments are possible without departing from the spirit and scope of the invention as defined in the appended claims, and equivalents thereof.

What is claimed is:

1. A process for making a fragmenting warhead liner attached to a nose of a selected ammunition round comprising the steps of:

a) forming a wrought steel body shaped like the round being outfitted with said fragmenting liner,
b) forming a hollow cylindrical canister to enclose said wrought steel body, said canister having a defined bottom thereon,
c) welding on a bottom sealing cap at the bottom of said canister to seal it,
d) filling the canister with uniform tungsten spheres as fragmentation preforms,
e) filling any spaces between the spheres with powdered 4340 steel to serve as binder material,
f) welding on a top sealing cap which also includes a stem which can be selectively used to create a vacuum within the canister,
g) applying a vacuum at the stem and heating the canister for purposes of degassing the canister,
h) crimping the stem shut and welding it in a crimped position,
i) applying a hot isostatic pressing (HIP) process to solidify the said binder material around and chemically bond it to the wrought steel body, while also solidifying a matrix of the tungsten spheres, closely packed and suspended within the solidified binder material,
j) cutting off all or part of the canister and of the top and bottom sealing caps, which results in forming a composite part, and
k) machining the composite part to a desired geometry.

2. The process for making a fragmenting warhead as in claim 1 wherein the composite part, rear and interior geometries are machined, resulting in a finished fragmenting warhead with an enhanced performance fragmentation cap integrally bonded to said fragmenting warhead.

3. The process for making a fragmenting warhead as in claim 2 wherein between steps a) and b), mechanical interlock features are first included on an outer profile of the wrought steel body, to strengthen the bond between the wrought steel body and the fragmentation cap.

4. The process for making a fragmenting warhead as in claim 3 wherein the composite part, rear and interior geometries are machined, resulting in a finished fragmenting warhead with an enhanced performance fragmentation cap integrally bonded to said fragmenting warhead.

* * * * *